US007278934B2

(12) United States Patent
McBride et al.

(10) Patent No.: US 7,278,934 B2
(45) Date of Patent: Oct. 9, 2007

(54) BASEBALL CATCHING AND THROWING SYSTEM

(76) Inventors: Kevin S. McBride, 1311 Watson Springs Rd., Watkinsville, GA (US) 30677; Francis P. Mullenbach, 1220 Hillcrest Dr., Watkinsville, GA (US) 30677

( * ) Notice: Subject to any disclaimer, the term of this patent is extended or adjusted under 35 U.S.C. 154(b) by 106 days.

(21) Appl. No.: 11/311,474

(22) Filed: Dec. 19, 2005

(65) Prior Publication Data

US 2007/0142131 A1 Jun. 21, 2007

(51) Int. Cl.
*A63B 69/00* (2006.01)

(52) U.S. Cl. ..... 473/451; 473/431; 473/422; 124/78

(58) Field of Classification Search ..... 473/451, 473/431, 422, 417, 419, 420; 124/6, 7, 54, 124/17
See application file for complete search history.

(56) References Cited

U.S. PATENT DOCUMENTS

| | | | | | |
|---|---|---|---|---|---|
| 1,086,067 | A * | 2/1914 | McMillan | 473/436 |
| 2,765,171 | A * | 10/1956 | Cook | 473/431 |
| 3,606,987 | A * | 9/1971 | Nomura | 473/436 |
| 3,713,658 | A * | 1/1973 | Cook | 473/436 |
| 4,497,485 | A | 2/1985 | Macoska | |
| 4,883,272 | A * | 11/1989 | Lay | 473/436 |
| 4,907,802 | A | 3/1990 | Gatin | |
| 4,974,843 | A * | 12/1990 | Henningsson | 473/431 |
| 4,995,371 | A | 2/1991 | Kuizinas | |
| 5,009,421 | A * | 4/1991 | Gatchel et al. | 473/436 |
| 5,417,196 | A | 5/1995 | Morrison et al. | |
| 5,485,994 | A * | 1/1996 | Underwood et al. | 473/451 |
| 5,733,209 | A * | 3/1998 | McIntyre, IV | 473/436 |
| 6,093,120 | A | 7/2000 | Luke, Jr. | |
| 6,186,132 | B1 * | 2/2001 | Ko | 124/6 |
| 6,458,048 | B1 | 10/2002 | McGrath | |
| 6,620,064 | B2 * | 9/2003 | Nickerson | 473/431 |
| 7,156,761 | B2 * | 1/2007 | Mesa | 473/451 |
| 2005/0209027 | A1 * | 9/2005 | Joseph | 473/431 |

* cited by examiner

*Primary Examiner*—Eugene Kim
*Assistant Examiner*—M. Chambers
(74) *Attorney, Agent, or Firm*—Dale J. Ream

(57) ABSTRACT

A baseball training device includes a target net from which balls will be fed to a unit that will throw the balls back to a player. The unit can be set to throw the balls in the air or on the ground so a variety of situations can be practiced.

1 Claim, 1 Drawing Sheet

BASEBALL CATCHING AND THROWING SYSTEM

TECHNICAL FIELD OF THE INVENTION

The present invention relates to the general art of amusement devices, and to the particular field of devices used to train skills, such as baseball skills.

BACKGROUND OF THE INVENTION

Baseball has long been one of America's most popular sports and since its inception, it has gradually caught worldwide attention and acceptance. For instance, baseball has been received in Canada, Japan, Taiwan, South America, and Europe, and is now included as an Olympic sport. Moreover, while the sport of baseball has spanned other continents, it has become an integral part of American family life from little league teams to professional organizations.

Children first learn about baseball from visiting ballparks, watching television, and participating in organized leagues. It fosters dreams of future recognition in almost every youngster, and for those kids fortunate enough to acquire the requisite skills, baseball has provided an avenue for obtaining scholarships in higher education, escaping the streets, and reaching prosperity. Among the skills necessary to succeed in baseball are catching ground balls, line drives, and pop flies, batting, and throwing. The more batting, throwing, and catching techniques are practiced, the more developed a child's skills become. Hence, the sooner a child is given the opportunity to develop and perfect these baseball skills, the greater the young athlete's chances of succeeding in the sport as an adolescent and an adult.

Ideally, a ball throwing machine should provide a player with a tireless partner that supplies balls as desired at a selected trajectory so that the player can develop or improve his hand-eye coordination. Amateur coaches in youth leagues often find it difficult to properly instruct youngsters because of the limited resources and/or man-power available per team. Typically, one baseball coach is required to singly provide both batting practice and fielding practice to 10-20 players. This may become physically challenging for the coach, and often results in wasted time and player boredom. For some coaches, the inability to bat or pitch may create a virtually insurmountable obstacle to properly instructing the players in the art of hitting and fielding a baseball.

Pitching machines are among the most widely used devices for training, however, they generally are only available to older children, adolescents, and adults. Furthermore, existing pitching means merely concentrate on developing a player's batting skills rather than the tripartite skills of throwing, catching, and hitting. Since these techniques take years to develop, a device which affords children the opportunity to practice these skills early in life would be extremely useful and beneficial. Therefore, there exists a need for a machine capable of training young children to field grounders, line drives, and pop flies, as well as hitting pitched balls, and to throw at a designated target.

SUMMARY OF THE INVENTION

The above-discussed disadvantages of the prior art are overcome by a training device that has a target net from which balls fall into a unit that will throw them back to the player. The trainer can be set to throw balls in the air or on the ground back to the player.

Using the trainer embodying the present invention will permit a player to practice throwing, catching and even hitting if desired for as long as he or she likes. The device is simple and easy to operate and thus is not likely to fail and it is easy to adjust so even young players will be able to use the device.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Referring to the figures, it can be understood that the present invention is embodied in a baseball training device 10 that can be used as a partner by a user to throw a baseball to and to receive a return toss.

Figure 1:
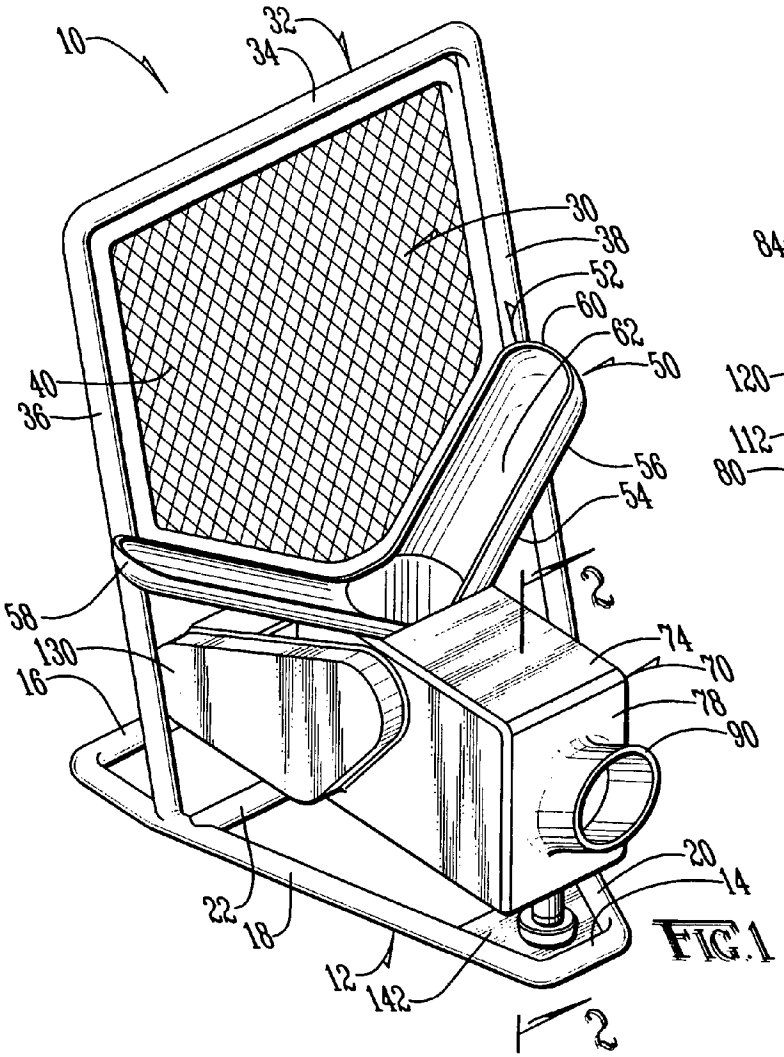
FIG. 1 is a perspective view of a baseball training device embodying the present invention.

Device 10 comprises a base unit 12 which includes a first end 14, a second end 16, two sides 18 and 20 which connect first end 14 to second end 16 and a cross bar 22 which extends between the two sides. As can be understood from FIG. 1, base unit 12 is in the form of a trapezoid. A net unit 30 is mounted on base unit 12 and includes a frame 32 which has a first end 34 which is a top end when the frame is in a use orientation such as shown in FIG. 1. Frame 32 further includes two sides 36 and 38 which extend between first end 34 and cross bar 22. Cross bar 22 forms one end of the net unit.

A target net 40 is mounted in the frame. A ball return unit 50 is mounted on base unit 12 and includes a ball chute unit 52 which has a V-shaped frame 54 located adjacent to target net 40 near base unit 12. Ball chute unit 52 further includes two troughs 56 and 58 which are angled toward each other. Each trough has a first end, such as first end 60 on trough 56, and second end, such as second end 64 of trough 56, with the first end of each trough being located higher than the second end of the trough when ball return unit 50 is mounted on the base unit. The second ends of troughs are located adjacent to each other.

A ball ejecting unit 70 includes a housing 72 which has a first surface 74 which is a top surface when housing 72 is in use such as shown in FIG. 1. Housing 72 further includes a second surface 76 which is a bottom surface when the housing is in use, a first end 78, a second end 80, an interior volume 82, an entrance port 84 defined through the first surface adjacent to the second ends of the troughs, and an exit port 86 defined through first end 78 of the housing.

A ball ejecting tube 90 is mounted on first end 78 of the housing of the ball ejecting unit adjacent to exit port 86. The ball ejecting tube has an inlet end 92 in communication with the interior volume of the housing via exit port 86 and an exit en 94.

First and second belt units 100 and 102 are located in the interior volume of the housing. Each belt unit includes a drive element, such as drive gear 104 on belt unit 100 to drive the belt in a manner that will be understood by those skilled in the art based on the teaching of the present disclosure. Each belt unit is mounted to extend in a horizontal direction when the ball ejecting unit is in a use orientation. First belt unit 100 is located above second belt unit 102 when the ball ejecting unit is in the use orientation so a gap 110 is defined between the first and second belt units. Gap 110 has an entrance location 112 adjacent to entrance port 84 and an exit location 114 adjacent to exit port 86 and inlet end 92 of the ball ejecting tube. The belts move in opposite directions as indicated by arrows 116 and 118 to have a portion thereof moving from the entrance location of the gap toward the exit location of the gap.

Figure 2:
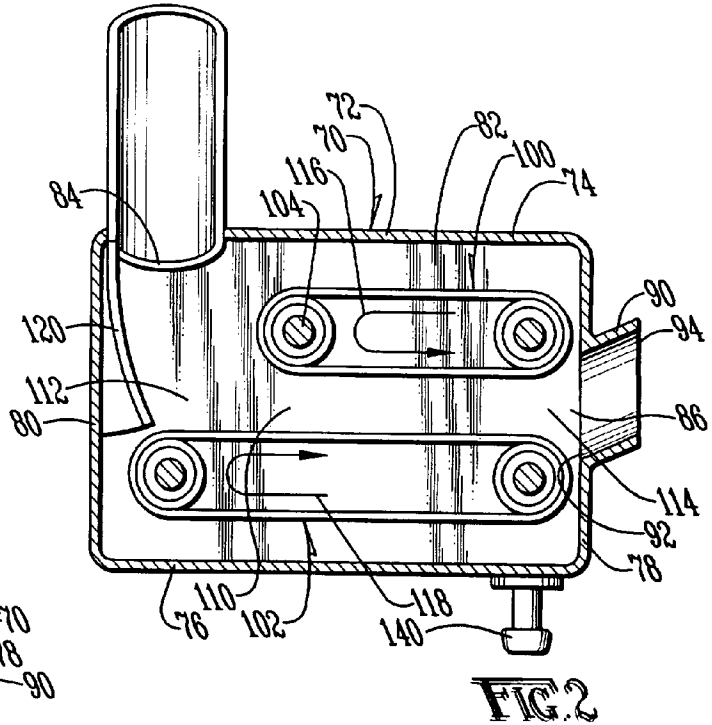
FIG. 2 is a view taken along line 2-2 of FIG. 1.

As will be understood from the teaching of this disclosure, gap 110 is sized to frictionally engage a baseball and move it from the entrance port 84 to exit port 86 with speed sufficient to launch it through ball ejecting tube 90 with force sufficient to move that ball back to a person who has thrown the ball toward unit 10. Tube 90 is swivably mounted on the housing so it can be oriented to be angled upwardly as shown in FIG. 2 or angled downwardly as desired.

A guide plate 120 is mounted on the housing in the interior volume of the housing and extends from entrance port 84 to second belt 102 adjacent to entrance location 112 of the gap. A drive unit 130 is mounted on the housing and is drivingly connected to the drive elements of the belts.

A height adjustment element 140 is mounted on the housing adjacent to the first end of the housing. Base unit 12 includes a platform 142 near first end 14 to support the height adjustment element 140. Height adjustment element 140 permits unit 10 to be used on uneven terrain or to further adjust the angle at which a ball is thrown back to a user. The platform permits height adjustment without difficulty caused by soft terrain or uneven terrain.

Use of unit 10 can be understood from the teaching of the foregoing disclosure and thus will not be presented in detail. A user throws a ball, such as a baseball, into target net 40. The ball rolls down the target net into the chute unit and is guided to entrance port 84 through which it passes. Guide plate 120 guides the ball to entrance location 112 of the belts. The belts are moving and frictionally engage the ball and move it toward exit port 86. The ball is then ejected from unit 10 through ball ejecting tube 90. If the tube is angled upwardly as shown in FIG. 2, the ball will move in a trajectory above the ground back to the user. If the tube is angled downwardly, the ball will move along the ground back to the user. The user can thus practice his or her fielding skills.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A baseball training device comprising:

A) a base unit which includes (1) a first end, (2) a second end, (3) two sides which connect the first end to the second end, and (4) a cross bar extending between the two sides;

B) a net unit mounted on the base unit and which includes (1) a frame having a first end which is a top end when the frame is in a use orientation, two sides which extend between the first end of the net unit and the cross bar of the base unit, the cross bar of the base unit forming one end of the net unit, and (2) a target net mounted in the frame;

C) a ball return unit which is mounted on the base unit and which includes (1) a ball chute unit which has a V-shaped frame located adjacent to the target net near the base unit, the ball chute unit further including two troughs which are angled toward each other and each of which has a first and second end with the first end of each trough being located higher than the second end of the same trough when the ball return unit is mounted on the base unit, the second ends of the troughs being located adjacent to each other, and (2) a ball ejecting unit which includes (a) a housing having a first surface which is a top surface when the housing is in use, a second surface which is a bottom surface when the housing is in use, a first end, a second end, an interior volume, an entrance port defined through the first surface adjacent to the second ends of the troughs, and an exit port defined through the first end of the housing, (b) a ball ejecting tube mounted on the first end of the housing of the ball ejecting unit, the ball ejecting tube having an inlet end in communication with the interior volume of the housing and an exit end, (c) first and second belt units in the interior volume of the housing, each belt unit including a drive element and each belt unit being mounted to extend in a horizontal direction when the ball ejecting unit is in a use orientation, the first belt unit being located above the second belt unit when the ball ejecting unit is in the use orientation so a gap is defined between the first and second belt units, the gap having an entrance location adjacent to the entrance port and an exit location adjacent to the inlet end of the ball ejecting tube, the belts moving in opposite directions to have a portion thereof moving from the entrance location of the gap toward the exit location of the gap, (d) a guide plate mounted on the housing in the interior volume of the housing and extending from the entrance port defined in the housing of the ball ejecting unit to the second belt adjacent to the entrance location of the gap, and (e) a drive unit mounted on the housing and drivingly connected to the drive elements of the belts;

D) a height adjustment element mounted on the housing adjacent to the first end of the housing; and F) a platform on the base unit adjacent to the first end of the base unit and located to support the height adjustment element on the base unit.

* * * * *